US008459639B2

(12) United States Patent
Nagao

(10) Patent No.: US 8,459,639 B2
(45) Date of Patent: Jun. 11, 2013

(54) SHEET CONVEYOR DEVICE, IMAGE READING DEVICE, AND IMAGE FORMING APPARATUS

(75) Inventor: Nobuhiro Nagao, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/361,037

(22) Filed: Jan. 30, 2012

(65) Prior Publication Data

US 2012/0193867 A1 Aug. 2, 2012

(30) Foreign Application Priority Data

Jan. 31, 2011 (JP) ..... 2011-018684

(51) Int. Cl.
*B65H 31/26* (2006.01)

(52) U.S. Cl.
USPC ..... 271/220; 271/207

(58) Field of Classification Search
USPC ..... 271/207, 220
See application file for complete search history.

(56) References Cited

U.S. PATENT DOCUMENTS

| | | | | |
|---|---|---|---|---|
| 7,055,818 | B2 | 6/2006 | Furusawa | |
| 7,537,206 | B2 * | 5/2009 | Tokuno | 270/58.12 |
| 7,697,883 | B2 | 4/2010 | Ogata et al. | |
| 2003/0160385 | A1 | 8/2003 | Furusawa | |
| 2006/0239735 | A1 | 10/2006 | Ogata et al. | |

FOREIGN PATENT DOCUMENTS

| | | | |
|---|---|---|---|
| JP | 2003-081514 | A | 3/2003 |
| JP | 2003-252511 | A | 9/2003 |
| JP | 2006-137571 | A | 6/2006 |
| JP | 2006-306522 | A | 11/2006 |
| JP | 2008-001503 | A | 1/2008 |
| JP | 2008-143616 | A | 6/2008 |

* cited by examiner

*Primary Examiner* — Michael McCullough

(74) *Attorney, Agent, or Firm* — Banner & Witcoff, Ltd.

(57) ABSTRACT

A conveyor device includes conveyor unit to convey a sheet along a path, a holder disposed at a downstream end of the path and holding sheets discharged from the conveyor unit in a stack, and a pressing unit. The pressing unit moves between a first position and a third position via a second position, contacts an uppermost sheet in the stack, and rises in an upward direction that approaches the third position as the sheets in the stack increase. The conveyor device also includes an urging member that does not apply an urging force to the pressing unit when the pressing unit is positioned between the first position and the second position; and applies an urging force to the pressing unit to urge the pressing unit toward the first position when the pressing unit is positioned between the second position and the third position.

5 Claims, 7 Drawing Sheets

SHEET CONVEYOR DEVICE, IMAGE READING DEVICE, AND IMAGE FORMING APPARATUS

CROSS REFERENCE TO RELATED APPLICATION

This application claims priority from Japanese Patent Application No. 2011-018684, filed on Jan. 31, 2011, the entire subject matter of which is incorporated herein by reference.

BACKGROUND

Aspects of the disclosure relate to a sheet conveyor device for conveying a sheet along a predetermined conveying path, an image reading device including the sheet conveyor device, and an image forming apparatus including the sheet conveyor device.

There is known an image forming apparatus which includes a sheet stacker for stacking sheets discharged after having been conveyed along a predetermined path, and which can avoid curling-up of the tailing ends of the stacked sheets, as viewed in a conveying direction, by pressing the stacked sheets on the sheet stacker with a sheet retaining member.

With the provision of the sheet pressing member, even when the sheet curling to some extent is discharged to the sheet stacker, the tailing end of the sheet may be kept from curling up. It is, therefore, possible to prevent or avoid collision of a sheet (specifically, its leading end), which is subsequently to the sheet stacker, against the sheet having been previously discharged and stacked in a curled-up state.

Further, because such collision may be avoided, it is also possible to prevent or avoid, for example, a drawback called a corner folding (i.e., folding of a corner at the leading end of a sheet) that is otherwise caused in the subsequently discharged sheet upon the collision against the previously discharged sheet. In addition, because such collision may be avoided, the already discharged sheet may be prevented or avoided from being pushed out of the sheet stacker upon the collision.

However, when the weight of the sheet pressing member is too heavy, or when an urging force acting on the sheet pressing member is too strong, the sheet pressing member may be not swung upwards even with the sheet striking against the sheet pressing member when the sheet is going to be discharged to the sheet stacker.

In that case, as illustrated in FIG. 7A, a sheet 103 discharged to a sheet stacker 101 is abruptly bent downwards in its moving direction upon contacting with a sheet pressing member 105. Therefore, the leading end of the sheet 103 collides against the sheet stacker 101, thus possibly causing a drawback, such as the corner folding at the leading end of the sheet 103.

On the other hand, when the weight of the sheet pressing member is light, or when the urging force acting on the sheet pressing member is weak, the sheet pressing member is swung upwards with the sheet, discharged to the sheet stacker, striking against the sheet pressing member. In that case, the sheet may be avoided from being abruptly bent downwards in its moving direction, and hence the occurrence of the above-described corner folding can also be avoided.

However, when the weight of the sheet pressing member is too light, or when the urging force acting on the sheet pressing member is too weak, the sheet pressing member cannot sufficiently hold down the already discharged sheets. In that case, as illustrated in FIG. 7B, a position of the tailing end of an already discharged sheet 107 in the moving direction cannot be sufficiently displaced downwards, thus causing the problem that the subsequently-discharged sheet 103 is more liable to collide against the already discharged sheet 107.

Stated another way, a pressing force applied from the sheet pressing member and acting on the sheet tends to cause the problem in any of the case where the pressing force is set excessively strong and the case where it is set excessively weak. Accordingly, optimizing the pressing force applied from the sheet pressing member and acting on the sheet is very difficult from the viewpoint of design.

SUMMARY

Aspects of the disclosure include a sheet conveyor device, which can prevent the leading end of a discharged sheet from being folded, and which can also avoid a subsequently discharged sheet from colliding against an already discharged sheet. Further, the disclosure provides an image reading device and an image forming apparatus, each including the sheet conveyor device.

BRIEF DESCRIPTION OF THE DRAWINGS

FIG. 2A is a vertical sectional view illustrating a state where a document supply tray is closed, and FIG. 2B is a vertical sectional view illustrating a state where the document supply tray is opened;

DETAILED DESCRIPTION

An illustrative embodiment will be described in detail with reference to the accompanying drawings. A sheet conveyor according to illustrative aspects of invention disclosure may for example, apply to a multifunction peripheral 1 as shown in FIG. 1.

First Embodiment

Figure 1:
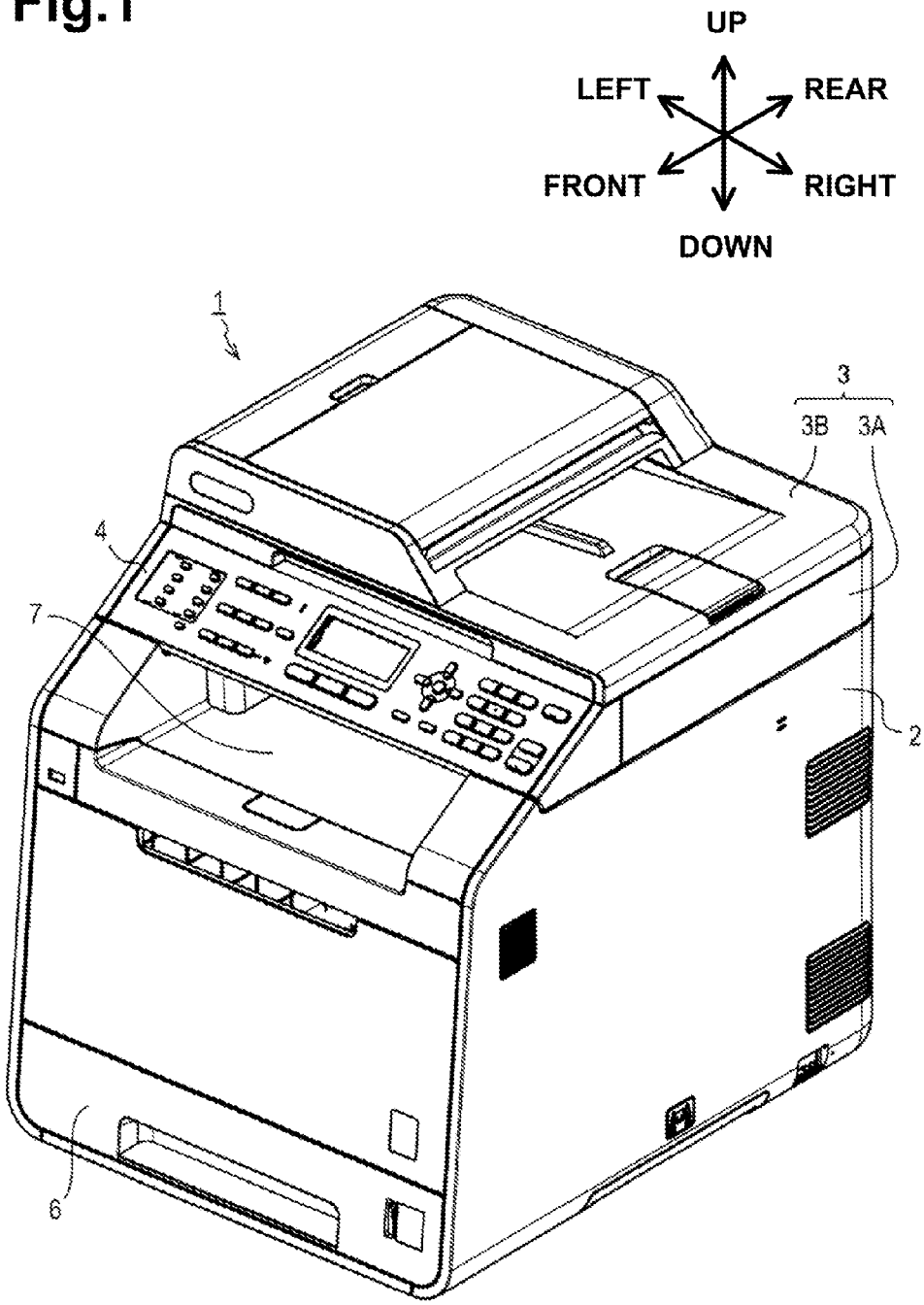
FIG. 1 is a perspective view of an example multifunction peripheral.

A multifunction peripheral 1, shown in FIG. 1, includes not only a function (scan function) of an image reading device, but also other functions (e.g., a print function, a copy function, and a facsimile receiving and transmitting function). It is to be noted that the following description is made by employing up and down directions, left and right directions, and front and rear directions, which are denoted in FIG. 1, for easier understanding of relative positional relationships among various components of the multifunction peripheral 1.

The multifunction peripheral 1 includes a printer unit 2, a scanner unit 3 mounted at a top of the printer unit 2, and an operating unit 4 disposed above the printer unit 2 and forward of the scanner unit 3. The printer unit 2 includes an image forming mechanism capable of forming an image on a recording medium in accordance with electrophotography. Further, a paper feed cassette 6 capable of being withdrawn in a forward direction is disposed in a lower portion of the printer unit 2, and a recording medium discharge section 7 to which the recording medium having been subjected to image formation is discharged is disposed in an upper portion of the printer unit 2.

The scanner unit 3 has a structure that an ADF (Auto Document Feeder) is added to an image scanner of the flat bed (FB) type. The scanner unit 3 includes an FB main body 3A and an ADF unit 3B covering the upper surface side of the FB main body 3A. The ADF unit 3B is rotatable about its rear end in a direction in which its front end is displaced up and down. Thus, the ADF unit 3B has a structure allowing it to be selectively displaced to a position where the ADF unit 3B covers a document placement surface that is provided by an upper surface of the FB main body 3A, and to a position where the document placement surface is exposed.

Figure 2A:
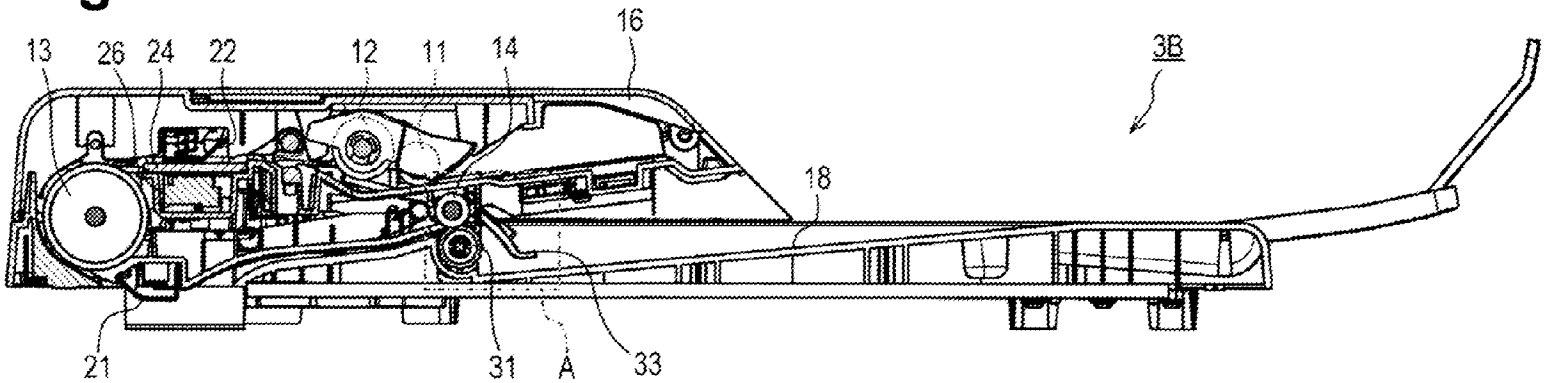
FIGS. 2A and 2B illustrate an image scanner unit included in the multifunction peripheral shown in FIG. 1; specifically.
Figure 2B:
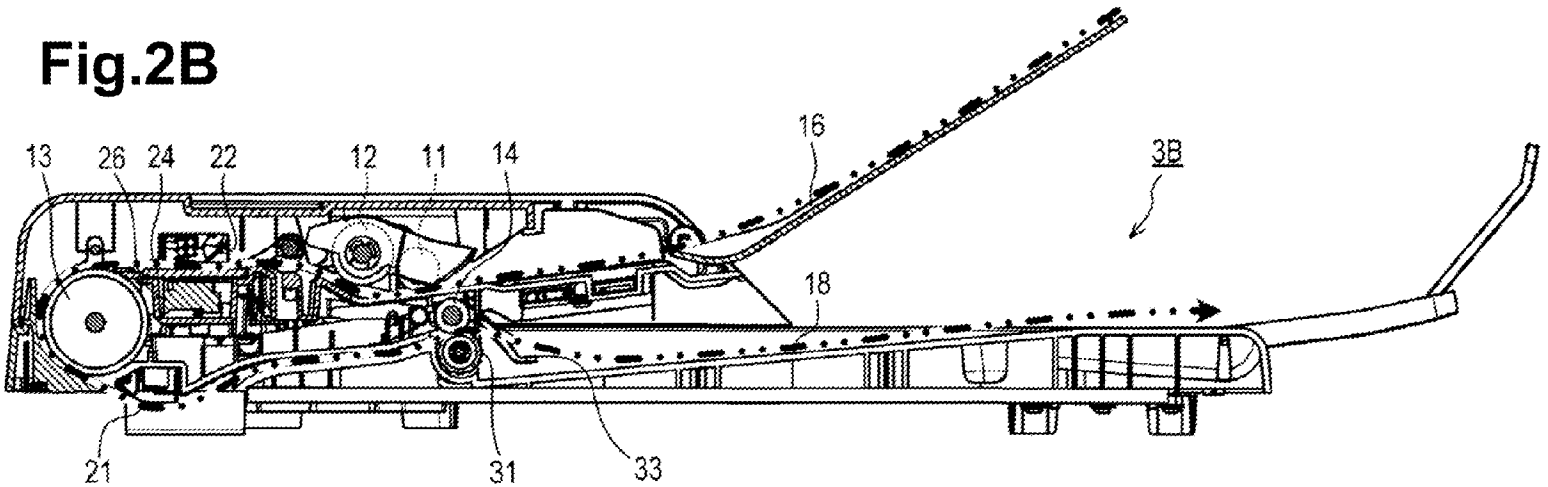

As shown in FIGS. 2A and 2B, the ADF unit 3B includes a supply roller 11, a separation roller 12, a main conveying roller 13, a discharge roller 14, etc., as rollers that are driven by power transmitted from a power source. A document placed on a document tray 16 can be conveyed to a document discharge section 18 by a group of those rollers along a conveying path in a substantially U-shape that is denoted by a two-dot-chain line in FIG. 2B.

The document tray 16 is pivotable to a closed position shown in FIG. 2A and to an open position shown in FIG. 2B. When the document tray 16 is moved to the closed position, it serves as a cover that covers a part of a top portion of the ADF unit 3B, and when the document tray 16 is moved to the open position, it can be utilized as the document tray 16.

A first document holder 21 is disposed at a position along one of opposed portions of the conveying path in the substantially U-shape. The first document holder 21 serves as a member for pressing the document, which is conveyed along the conveying path, against a first ADF glass (not shown) disposed in the FB main body 3A.

A first image sensor (not shown) capable of reciprocally moving within the FB main body 3A is disposed in the FB main body 3A. When the first image sensor is moved to a position opposed to the first document holder 21 with the first ADF glass interposed therebetween, an image can be read by the first image sensor from a document being conveyed along the conveying path.

A second document holder 22 is disposed at another position along the conveying path in the substantially U-shape, i.e., at a position along a portion of the conveying path on the side (on the upstream side in the conveying direction) opposite to the position where the first document holder 21 is disposed. The second document holder 22 serves as a member for pressing the document, which is conveyed along the conveying path, against a second ADF glass 24.

A second image sensor 26 is disposed inside the ADF unit 3B at a position opposed to the second document holder 22 with the second ADF glass 24 interposed therebetween, and an image can also be read by the second image sensor 26 from a document being conveyed along the conveying path. Thus, in the multifunction peripheral 1, images can be read by the first image sensor and the second image sensor from both front and rear surfaces of a document being conveyed along the conveying path.

Figure 3:
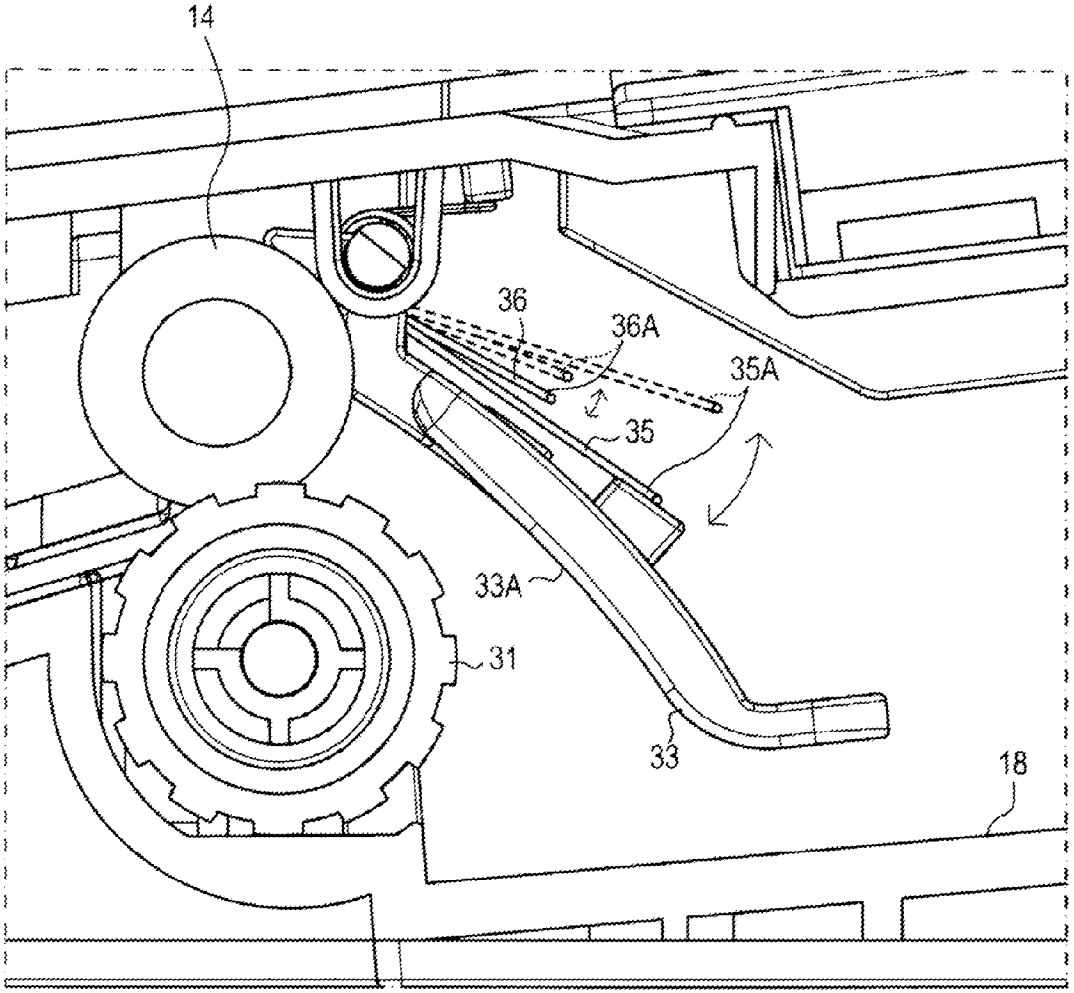
FIG. 3 is an enlarged view of example a stack lever and thereabout (i.e., a portion A denoted in FIG. 2A) in a first illustrative embodiment.

As shown in FIG. 3 in enlarged scale, a nip roller 31 is disposed under the discharge roller 14 for discharging the document to the document discharge section 18 in cooperation with the discharge roller 14. Further, a stack lever 33 is disposed at a position where the leading end of the document in the conveying direction makes contact with the stack lever 33 when the document is discharged by the discharge roller 14 and the nip roller 31.

The stack lever 33 is disposed such that its upper end is located at a position closer to the conveying path defined by the discharge roller 14 and the nip roller 31 than its lower end, and the stack lever 33 is constructed to be pivotable about the upper end thereof. Further, the stack lever 33 has a sloped surface 33A extending obliquely downwards, and the document discharged by the discharge roller 14 and the nip roller 31 makes contact with the sloped surface 33A.

A torsion coil spring 35 and a torsion coil spring 36 are disposed above the stack lever 33. The torsion coil spring 35 has an arm 35A that is always held in a state contacting with the stack lever 33. The arm 35A urges the stack lever 33 in a direction that causes the stack lever 33 to swing downwards (clockwise direction in FIG. 3).

Further, when the stack lever 33 is swung upwards against an urging force of the torsion coil spring 35, the torsion coil spring 35 is elastically deformed and the arm 35A is displaced from a position denoted by solid lines in FIG. 3 to a position denoted by broken lines.

On the other hand, the torsion coil spring 36 is held in a position away from the stack lever 33, as denoted by solid lines in FIG. 3, in a state where the stack lever 33 is displaced to a lowermost position. The position of the stack lever 33 in that state will be referred to as a "first position" hereinafter.

When the stack lever 33 is pivoted and displaced upwards to some extent, an arm 36A of the torsion coil spring 36 makes contact with the stack lever 33. The position of the stack lever 33 in that state will be referred to as a "second position" hereinafter.

When the stack lever 33 is further pivoted upwards against the urging force of the torsion coil spring 36, the torsion coil spring 36 is elastically deformed and the arm 36A is displaced from a position denoted by the solid lines in FIG. 3 to a position denoted by broken lines. The position of the stack lever 33 in that state will be referred to as a "third position" hereinafter.

Accordingly, the stack lever 33 is in a state urged by the torsion coil spring 35 within a range from the first position to the second position, and in a state urged by both the torsion coil spring 35 and the torsion coil spring 36 within a range from the second position to the third position. Further, an incline angle of the inclined surface 33A of the stack lever 33 relative to a horizontal plane gradually reduces as the stack lever 33 is moved from the first position toward the third position.

Figure 4A:
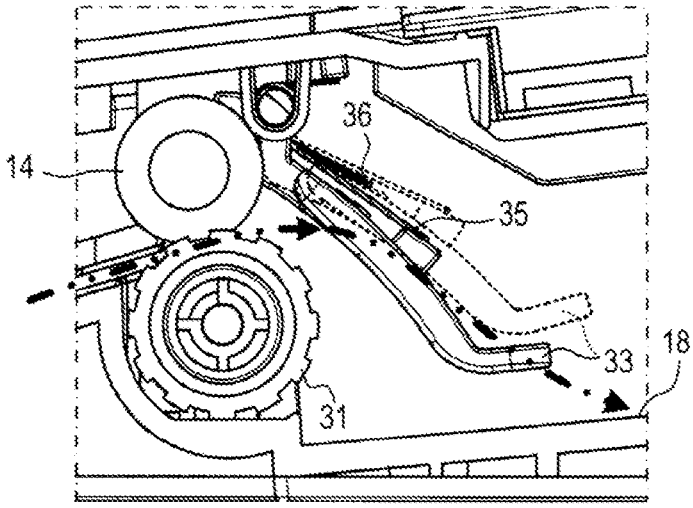
FIGS. 4A to 4C are explanatory views of example to explain behaviors of the stack lever in the first embodiment.

In the multifunction peripheral 1 having the above-described construction, when the document is conveyed in the ADF unit 3B, the stack lever 33 is in the state displaced to the first position, as illustrated in FIG. 4A, in a stage where the number of documents having been already discharged to the document discharge section 18 is comparatively small. When the document is discharged by the discharge roller 14 and the nip roller 31 in that state, the leading end of the discharged document in the conveying direction makes contact with the stack lever 33.

However, because the urging force of the torsion coil spring 35 is set comparatively weak, the stack lever 33 is pivoted and displaced upwards (e.g., to a position denoted by broken lines in FIG. 4A) upon the leading end of the document making contact with the stack lever 33. Therefore, in contrast to the the case where the stack lever 33 is not raised upwards, the moving direction of the document is prevented from being abruptly bent downwards upon the document making contact with the stack lever 33, and the leading end of the document is also prevented from making contact with the upper surface of the document discharge section 18 at a steep angle. Accordingly, the occurrence of, e.g., the corner folding at the leading end of the document can be more readily prevented than in the case where it is more difficult to move the stack lever 33 in an upward direction.

Figure 4B:
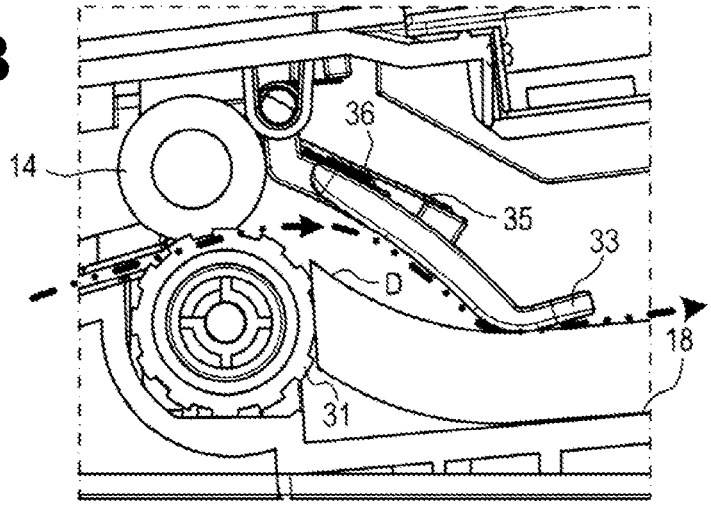

On the other hand, as the number of documents D having been discharged to the document discharge section 18 increases, a top of the already discharged documents D reaches a position where the top document contacts the lower end of the stack lever 33. Thereafter, the stack lever 33 comes into the state holding down the discharged documents D. At that time, the stack lever 33 is still in the state lightly urged by the torsion coil spring 35. As the number of the discharged documents D further increases, the stack lever 33 is caused to gradually pivot upwards and then reaches the second position as shown in FIG. 4B.

At the time when the stack lever 33 reaches the second position, the stack lever 33 comes into the state contacting with the arm 36A of the torsion coil spring 36. As the number of the discharged documents D further increases, the stack lever 33 is caused to gradually swing upwards. During such a period, the stack lever 33 is in the state strongly urged by both the torsion coil springs 35 and 36.

Figure 4C:
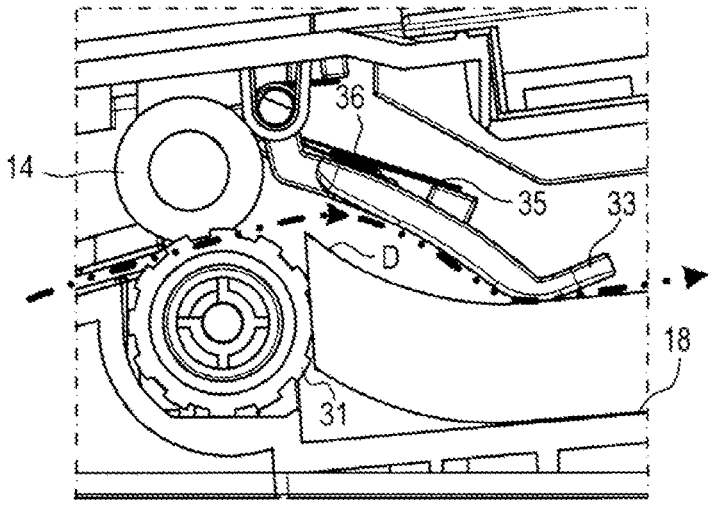

Thus, during the period in which the stack lever 33 is pivoted from the second position to the third position, as shown in FIG. 4C, the stack lever 33 is in the state firmly holding down the discharged documents D from above. As such the discharged documents D may be prevented from curling up or being in a loose state at the trailing ends. As a result, a subsequently discharged document may be prevented from making contact with and colliding with the ends of the stacked discharged documents D.

Stated another way, in the multifunction peripheral 1, the urging force exerted on the stack lever 33 can be changed step by step in the movable range of the stack lever 33 such that an appropriate urging force acts on the stack lever 33 depending on the number of discharged documents D stacked on the document discharge section 18.

More specifically, in a stage where the number of the discharged documents D is small, the urging force exerted on the stack lever 33 is set relatively weak to avoid the corner folding at the leading end of the document. In a stage where the number of the discharged documents D reaches a threshold value, the urging force exerted on the stack lever 33 is set relatively strong to firmly hold down the discharged documents D stacked on the document discharge section 18.

Unlike the case where the urging force exerted on the stack lever 33 is set relatively weak simply to avoid the corner folding at the leading end of the document, the first embodiment can eliminate the problem that a force acting to hold down the documents becomes insufficient when the number of the already discharged documents D on the document discharge section 18 increases. Also, unlike the case where the urging force exerted on the stack lever 33 is set relatively strong simply to firmly hold down the documents, the first embodiment can eliminate the problem that the stack lever 33 becomes harder to displace potentially causing the document to be folded.

Second Embodiment

A second embodiment will be described below. It is to be noted that, in the following explanation of the second embodiment, different points from the first embodiment are primarily described in detail and detailed explanation of common components to those in the first embodiment is omitted by assigning the common components with the same reference numerals as those in the first embodiment.

Figure 5:
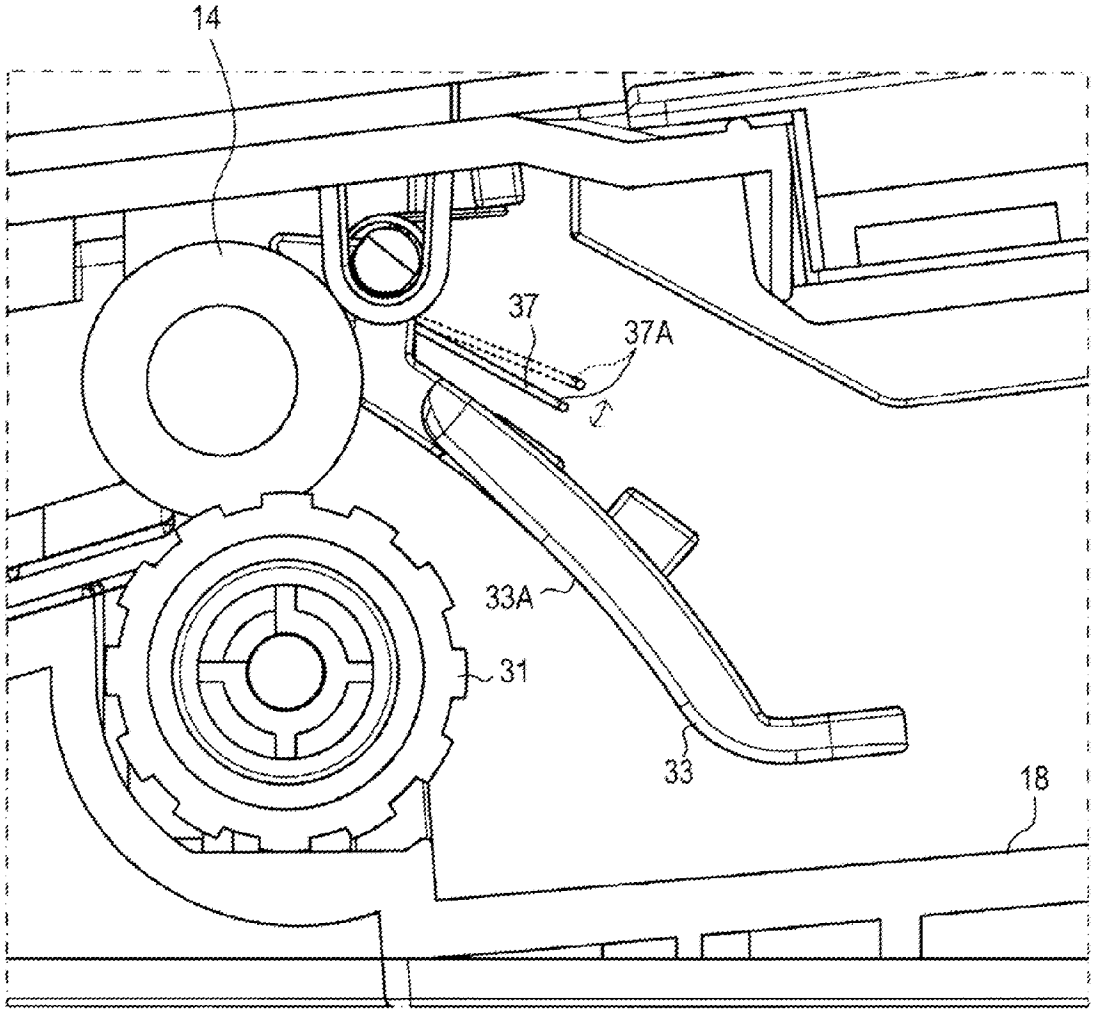
FIG. 5 is an enlarged view of example a stack lever and thereabout in a second illustrative embodiment.

As shown in FIG. 5, the stack lever 33 in the second embodiment is urged by a single torsion coil spring 37. The torsion coil spring 37 functions substantially in a similar manner to the torsion coil spring 36 in the first embodiment.

More specifically, when the stack lever 33 is in the range from the first position to the second position, the torsion coil spring 37 does not make contact with the stack lever 33. When the stack lever 33 is in the range from the second position to the third position, the torsion coil spring 37 urges the stack lever 33 in a direction in which the stack lever 33 is caused to pivot downwards.

In the second embodiment, a member corresponding to the torsion coil spring 35 in the first embodiment is not provided, and the stack lever 33 is pivoted downwards by its own weight when the stack lever 33 is in the range from the first position to the second position.

Figure 6A:
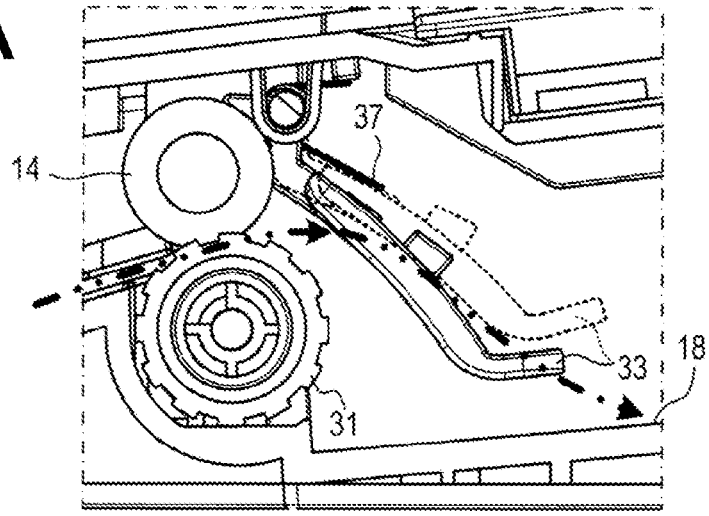
FIGS. 6A to 6C are explanatory views of examples to explain behaviors of the stack lever in the second illustrative embodiment.

Even with the construction described above, in the stage where the number of documents having been discharged to the document discharge section 18 is comparatively small, as illustrated in FIG. 6A, the stack lever 33 is pivoted and displaced upwards (e.g., to a position denoted by broken lines in FIG. 6A) when the leading end of the document strikes against the stack lever 33.

Unlike the case where the stack lever 33 is not raised upwards, therefore, the moving direction of the discharged document is prevented from being abruptly bent downwards upon the document making contact with the stack lever 33, and the leading end of the document is also prevented from making contact with the upper surface of the document discharge section 18 at a steep angle. Accordingly, the occurrence of, e.g., the corner folding at the leading end of the document can be more readily be prevented than in the case where it is more difficult to move the stack lever 33 in an upward direction.

Figure 6B:
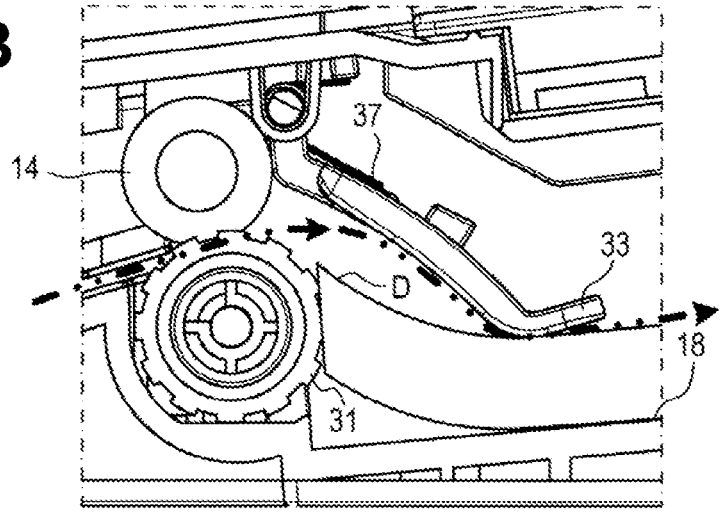

Further, as shown in FIG. 6B, at the time when the stack lever 33 reaches the second position, the stack lever 33 comes into the state contacting with an arm 37A of the torsion coil spring 37. Thereafter, as the number of the discharged documents D increases, the stack lever 33 is caused to gradually pivot upwards, whereby the stack lever 33 comes into the state strongly urged by the torsion coil spring 37.

Figure 6C:
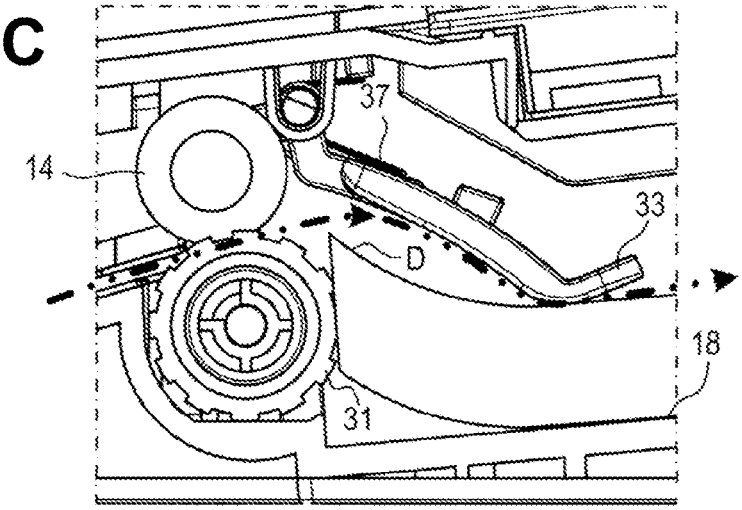
Figure 7A:
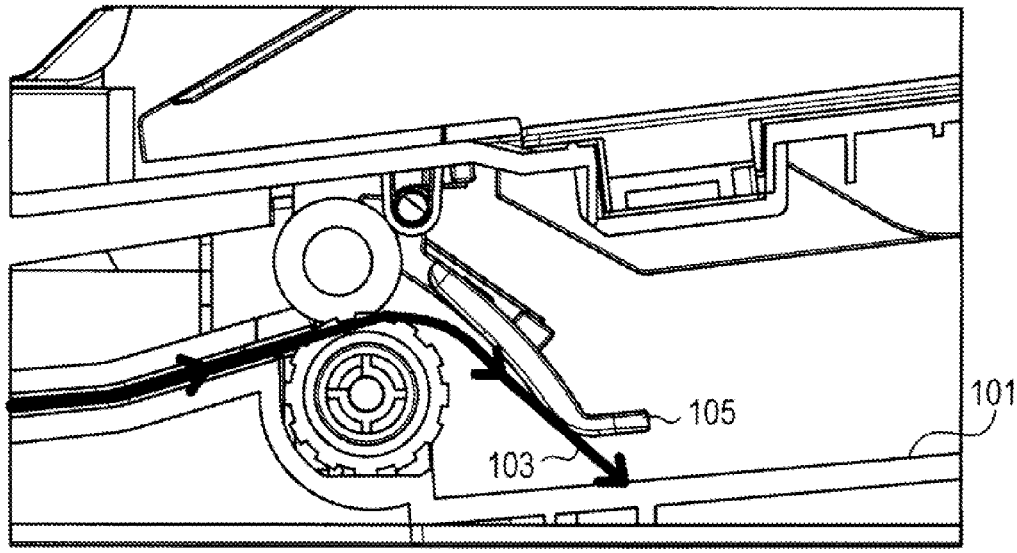
Fig.7A (prior art)
FIG. 7A is an explanatory view of example to explain a problem caused when a pressing force of a stack lever is too strong.
Figure 7B:
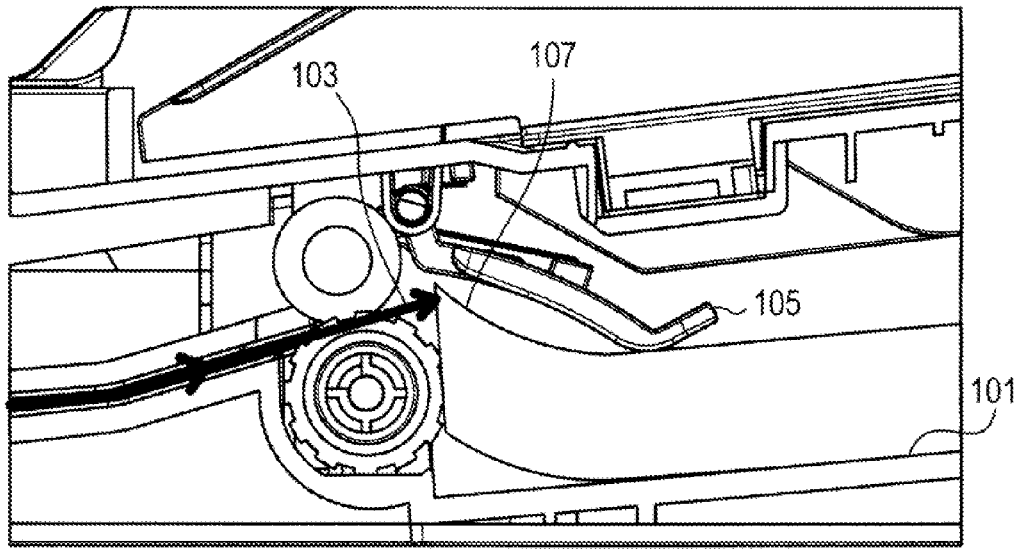
Fig.7B (prior art)
FIG. 7B is an explanatory view to explain a problem caused when the pressing force of the stack lever is too weak.

Thus, during the period in which the stack lever 33 is pivoted from the second position to the third position, as illustrated in FIG. 6C, the stack lever 33 is in the state firmly holding down the discharged documents D from above. As such, the discharged documents D may be prevented from curling up or being in a loose state at the trailing ends.

Stated another way, even when the single torsion coil spring 37 is employed as described above, the urging force exerted on the stack lever 33 can be changed step by step in the movable range of the stack lever 33 such that an appropriate urging force acts on the stack lever 33 depending on the number of discharged documents D stacked on the document discharge section 18.

Modifications, etc.

While illustrative embodiments have been described above, the disclosure is not limited to the foregoing concrete embodiments and the present invention can be practiced in various forms other than the embodiments disclosed herein.

For example, while the illustrative embodiments have been described above in connection with the case where the document discharged to the document discharge section 18 in the ADF unit 3B is held down by using the stack lever 33, a recording medium discharged to recording medium discharge section 7 in the printer unit 2 may be held down with a similar structure to that of the stack lever 33.

In that case, it is also possible to avoid the leading end of the discharged recording medium from being folded, and to avoid a subsequently discharged recording medium from colliding with previously discharged recording media.

Further, while the illustrative embodiments have been described above in connection with the multifunction peripheral 1 that includes both the function as the image reading apparatus (i.e., the scan function) and the function as the image forming apparatus (i.e., the print function), the disclosure can also be applied to, e.g., a single-function image scanner only functioning as an image reading apparatus and a single-function printer only functioning as an image forming apparatus.

In the illustrative embodiments described above, the supply roller 11, the separation roller 12, the main conveying roller 13, and the discharge roller 14 correspond to one example of a conveyor though it will be appreciated that other configurations are possible and within the knowledge of one or ordinary skill in the art. The document discharge section 18 corresponds to one example of a stack member though it will be appreciated that other configurations are possible and within the knowledge of one or ordinary skill in the art. The stack lever 33 corresponds to one example of a sheet pressing member though it will be appreciated that other configurations are possible and within the knowledge of one or ordinary skill in the art. Further, each of the torsion coil springs 36 and 37 correspond to one example of an urging member and the torsion coil spring 35 corresponds to one example of a second urging member though it will be appreciated that other configurations are possible and within the knowledge of one or ordinary skill in the art.

While certain aspects of the disclosure have been shown and described with reference to certain illustrative embodiments thereof, it will be understood by those skilled in the art that various changes in form and details may be made therein without departing from the spirit and scope of the invention as defined by the appended claims.

What is claimed is:

1. A sheet conveyor device comprising:

a conveyor unit configured to convey a sheet one by one along a predetermined conveying path;

a sheet holder disposed at a downstream end of the conveying path in a conveying direction and configured to hold one or more sheets discharged from the conveyor unit in a stack;

a sheet pressing unit configured to:

move between a first position and a third position via a second position, wherein the third position is above the first position;

contact an uppermost sheet in the stack, from above; and rise in an upward direction that approaches the third position as the number of sheets in the stack increases; and a first urging member configured to:

not apply an urging force to the sheet pressing unit when the sheet pressing unit is positioned between the first position and the second position; and apply an urging force to the sheet pressing unit to urge the sheet pressing unit toward the first position when the sheet pressing unit is positioned between the second position and the third position.

2. The sheet conveyor device according to claim 1, further comprising a second urging member configured to apply the urging force to the sheet pressing unit to urge the pressing unit toward the first position when the sheet pressing member is between the first position and the second position, and apply the urging force to the sheet pressing unit to urge the pressing unit toward the first position in cooperation with the first urging member, when the sheet pressing unit is between the second position and the third position.

3. The sheet conveyor device according to claim 1, wherein the sheet pressing member includes an upper end and a lower end, the upper end disposed closer to the conveying path defined by the conveyor unit than the lower end, the lower end being pivoted about the upper end to be movable between the first position and the third position, and an inclined surface extending downwards, the sheet discharged from the conveyor unit making contact with the sheet pressing member at the inclined surface, wherein an incline angle of the inclined surface relative to a horizontal plane decreases as the sheet pressing member is pivoted from the first position to the third position.

4. An image reading comprising:

a sheet conveyor device including a conveyor unit configured to convey a sheet one by one along a predetermined conveying path;

a sheet holder disposed at a downstream end of the conveying path in a conveying direction and configured to hold one or more sheets discharged from the conveyor unit in a stack;

a sheet pressing unit configured to:

move between a first position and a third position via a second position, wherein the third position is above the first position;

contact an uppermost sheet in the stack, from above; and rise in an upward direction that approaches the third position as the number of sheets in the stack increases; and a first urging member configured to:

not apply an urging force to the sheet pressing unit when the sheet pressing unit is positioned between the first position and the second position; and apply an urging force to the sheet pressing unit to urge the sheet pressing unit toward the first position when the sheet pressing unit is positioned between the second position and the third position; and a reading unit configured to read an image from the sheet, wherein the sheet is a document to be read.

5. An image forming apparatus comprising:

a sheet conveyor device including a conveyor unit configured to convey a sheet one by one along a predetermined conveying path;

a sheet holder disposed at a downstream end of the conveying path in a conveying direction and configured to hold one or more sheets discharged from the conveyor unit in a stack;

a sheet pressing unit configured to:

move between a first position and a third position via a second position, wherein the third position is above the first position;

contact an uppermost sheet in the stack, from above; and rise in an upward direction that approaches the third position as the number of sheets in the stack increases; and a first urging member configured to:

not apply an urging force to the sheet pressing unit when the sheet pressing unit is positioned between the first position and the second position; and apply an urging force to the sheet pressing unit to urge the sheet pressing unit toward the first position when the sheet pressing unit is positioned between the second position and the third position; and an image forming unit configured to form an image onto the sheet, wherein the sheet is a recording medium.

* * * * *